US008591283B2

(12) United States Patent
Hahn

(10) Patent No.: US 8,591,283 B2
(45) Date of Patent: Nov. 26, 2013

(54) ACTION FIGURE

(76) Inventor: Theodore W. Hahn, Kansas City, MO (US)

( * ) Notice: Subject to any disclaimer, the term of this patent is extended or adjusted under 35 U.S.C. 154(b) by 238 days.

(21) Appl. No.: 13/248,766

(22) Filed: Sep. 29, 2011

(65) Prior Publication Data

US 2013/0084770 A1 Apr. 4, 2013

(51) Int. Cl.
*A63H 3/20* (2006.01)

(52) U.S. Cl.
USPC ..... 446/330

(58) Field of Classification Search
USPC ..... 446/330, 381
See application file for complete search history.

(56) References Cited

U.S. PATENT DOCUMENTS

| | | | | |
|---|---|---|---|---|
| 2,622,369 | A * | 12/1952 | Beal | 446/369 |
| 4,578,045 | A * | 3/1986 | Mayer et al. | 446/330 |
| 5,017,173 | A * | 5/1991 | Shapero et al. | 446/374 |
| 6,478,653 | B1 | 11/2002 | Langton | |
| 6,800,016 | B2 | 10/2004 | Wittenberg et al. | |
| 7,077,717 | B2 * | 7/2006 | Cheng et al. | 446/376 |
| 7,566,256 | B2 * | 7/2009 | Wai | 446/381 |

FOREIGN PATENT DOCUMENTS

EP 0872267 B1 11/1998

* cited by examiner

*Primary Examiner* — Michael Dennis
(74) *Attorney, Agent, or Firm* — Erickson Kernell Derusseau & Kleypas, LLC

(57) ABSTRACT

An action figure with a unitary construction, including a spine, upper torso, rib plates, pelvis, legs, shoulders, arms and a head. The action figure is formed from a flexible material to enhance the natural movement of the action figure.

6 Claims, 4 Drawing Sheets

ACTION FIGURE

FIELD

The present invention relates to posable figures and, in particular, to a posable figure having a flexible spine and joints to present natural articulation, movement and poses.

BACKGROUND

Articulated and posable figures such as dolls are commonly used by children as toys and may be collected by adults. A common posable figure has a human form, including a torso, a head, two arms and legs attached and movable with respect to the torso. The shape or form of the figure is typically provided by molding the torso in a desired shape or form from a rigid plastic material. Ball and socket-type joints are typically used to connect the arms, legs and head to the torso.

These posable figures are not capable of accurately simulating life-like movement and attaining a life-like pose. In particular, rigid torsos used in prior art posable figures are not capable of being moved in a manner that simulates the movements and positions made possible by the human torso, spine, arms and legs. As a result, these prior art figures cannot be used to simulate complex and subtle human movement and poses, such as an athletic event like snowboarding. The ball and socket-type joints used in prior art posable figures also do not allow for the natural range of motion necessary for the figure to move in a way that simulates human movement. Because the parts are not integrally formed, movement of one part does not typically affect another part resulting in a disjointed, unnatural movement and poses.

SUMMARY

The present invention features an action figure, including a unitary form with a spine, upper torso, a plurality of rib plates, a pelvis with legs extending therefrom, arms extending from opposite shoulders of the upper torso, and a head. The upper torso, spine, rib plates, pelvis, legs and arms are a singular form made from a resilient, relatively soft material. The spine may be formed from a stiffer material than the rest of the body to provide enhanced stability to the form. The shoulders, elbows, hips and knees provide a natural joint movement of the associated appendages.

DETAILED DESCRIPTION

Figure 1:
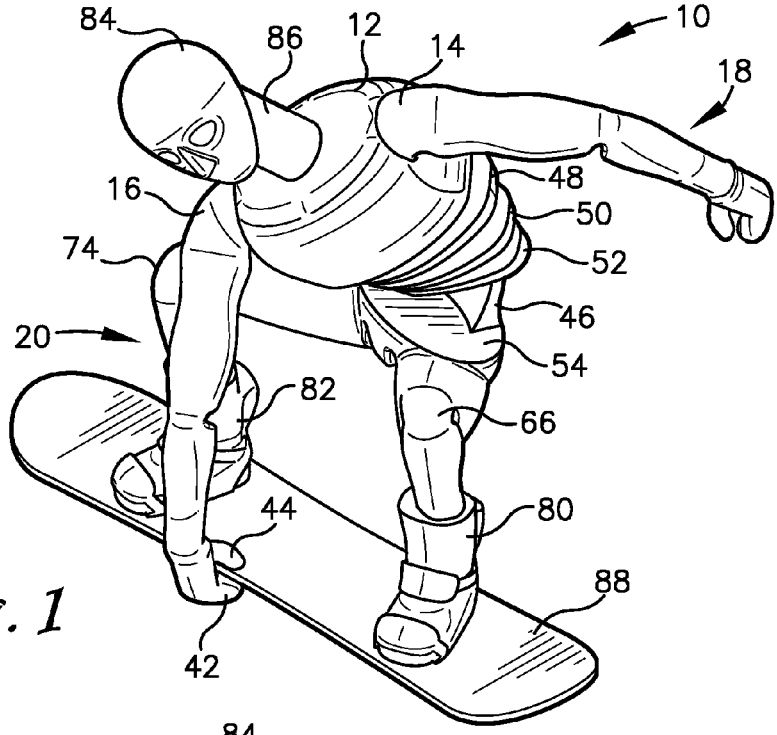
FIG. 1 is a perspective view of an action figure of the present invention shown posed grasping a snowboard.

Referring to the figures, an action figure of the present invention is generally indicated by reference numeral 10. Action figure 10 includes an upper torso 12 with a left shoulder 14 and a right shoulder 16, and a left arm 18 and a right arm 20 attached thereto, respectively. Left arm 18 includes an upper arm portion 22, an elbow 24, a forearm portion 26 and a left hand 28. Likewise, right arm 20 includes an upper portion 30, an elbow 32, a forearm portion 34 and a right hand 36. Left hand 28 includes a finger pad or separate fingers 38 and a thumb 40. Right hand 36 includes a finger pad or separate fingers 42 and a thumb 44.

A spine 46 connects the upper torso 12 to rib plates 48, 50 and 52, which are evenly spaced apart along the spine 46. The spine 46 terminates at a pelvis 54, which includes left 56 and right 58 hips and a left leg 60 and a right leg 62 attached thereto. Left leg 60 includes a thigh portion 64, a knee 66, a lower leg portion 68, and a foot 70. The right leg 62 includes a thigh portion 72, a knee 74, a lower leg portion 76 and a foot 78. As illustrated, each foot 70 and 78 is molded into boots 80 and 82, respectively. A head 85 with a neck 86 is rotatably coupled to the upper torso 12. The boots 80 and 82 are fastened to a snowboard 88 with adhesive, epoxy, glue or other fastening means.

Figure 5:
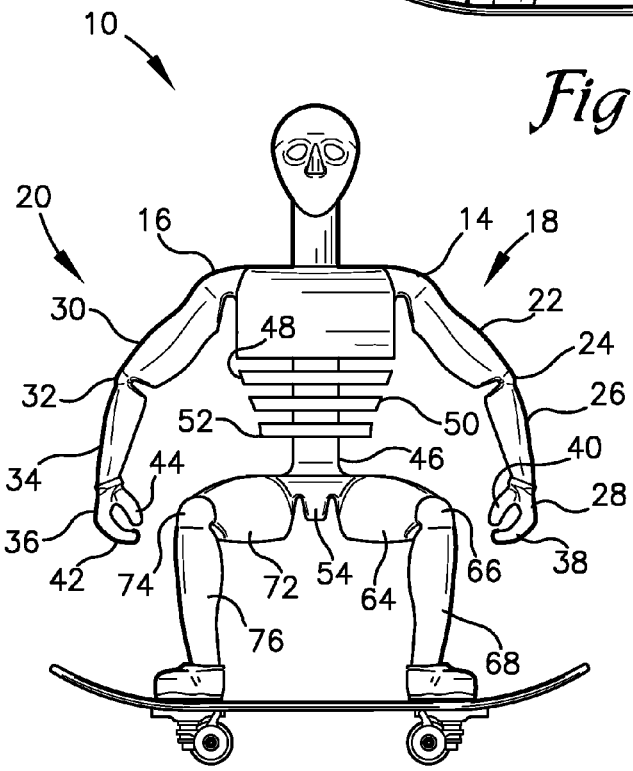
FIG. 5 is a front elevation view of the action figure shown with a skateboard.
Figure 6:
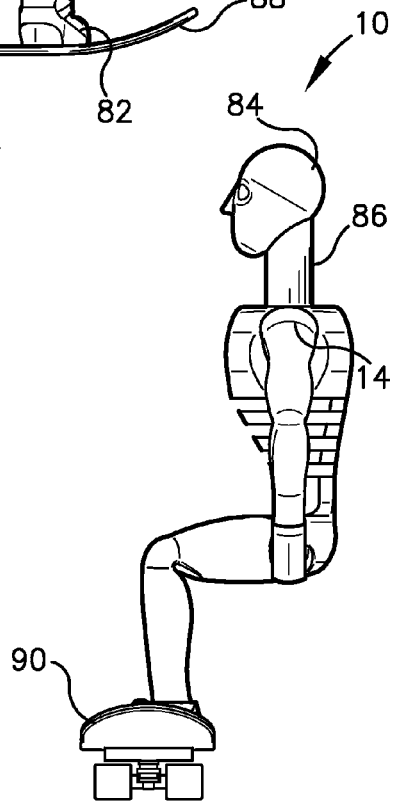
FIG. 6 is a side elevation view of the action figure of FIG. 5.
Figure 7:
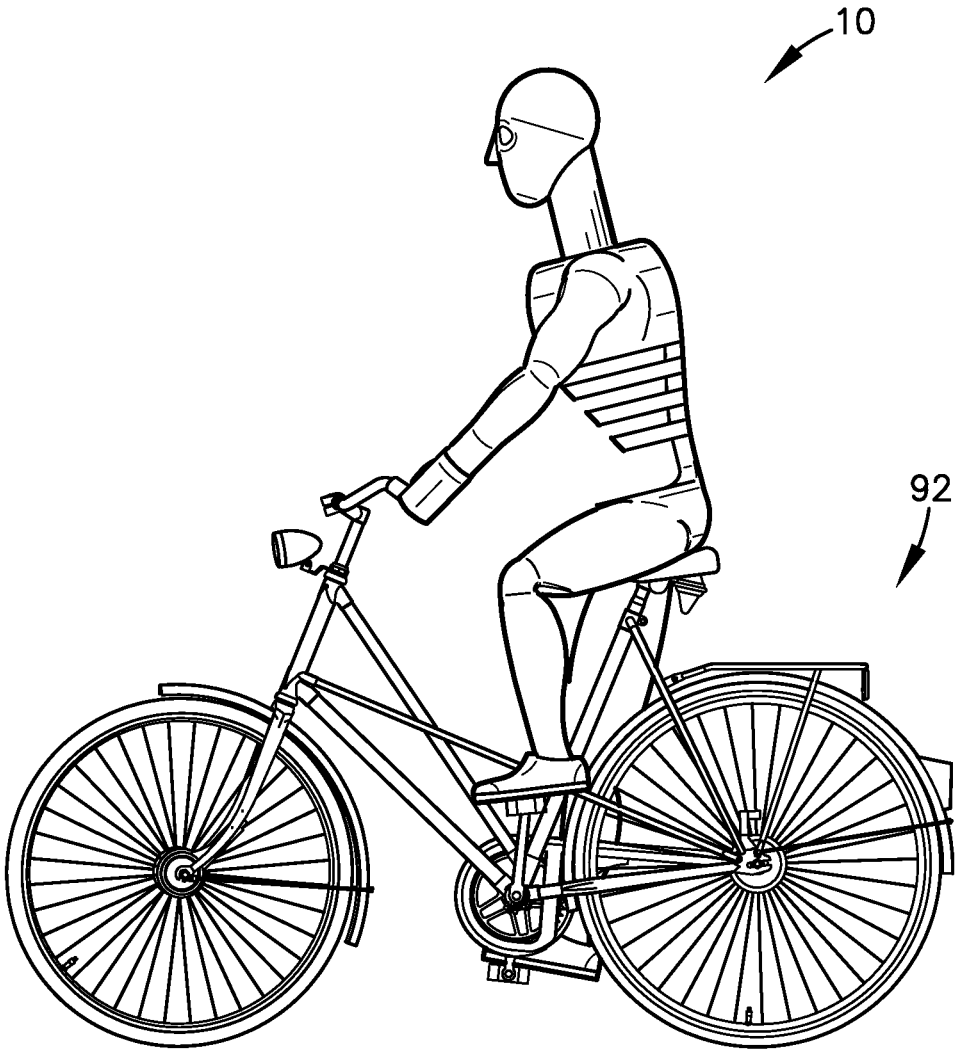
FIG. 7 is a side elevation view of the action figure shown with a bicycle.
Figure 8:
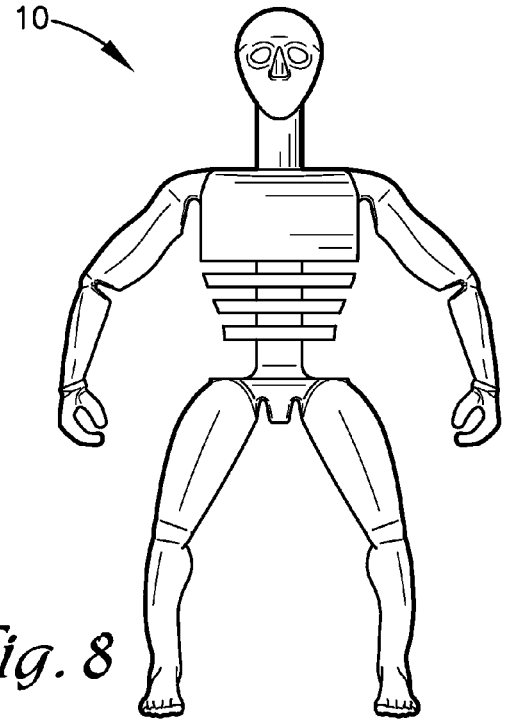
FIG. 8 is a front elevation view of the action figure in an upright position.
Figure 9:
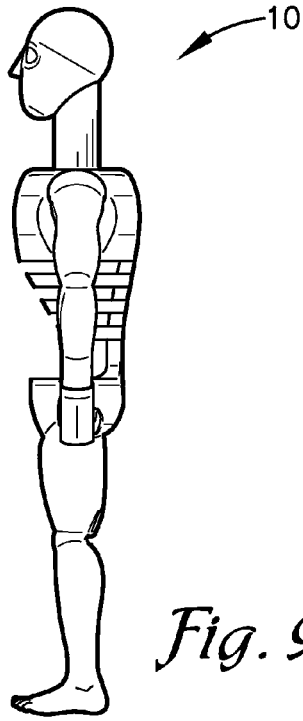
FIG. 9 is a side elevation view of the action figure of FIG. 8.
Figure 10:
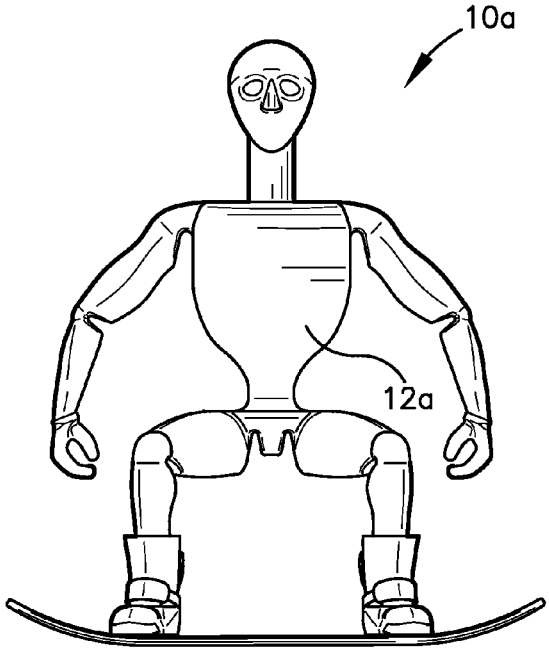
FIG. 10 is a front elevation view of an alternative embodiment of the action figure shown with a snowboard.

As illustrated in FIGS. 1-4, the action FIG. 10 is configured in a squatting or sitting position with its legs 60 and 62 spaced apart and its feet 70 and 78 pointed generally outwardly that is particularly suited for posing with a snowboard 88 (FIGS. 1-4) or skateboard 90 (FIGS. 5 and 6) or a bicycle 92 (FIG. 7), or upright (FIGS. 9 and 10), for example.

The action FIG. 10 may have a unitary construction, molded in a single piece using injection molding, for example, from a single base material such as a polyurethane, urethane, or silicone rubber material with a Shore hardness of between 30 Shore A and 80 Shore D, and preferably between 30 Shore A and 80 Shore A, and an elastic modulus of between 2 and 10 MPa, and preferably between 4 and 8 MPa. This combination of Shore hardness and elastic modulus provides a natural feel and movement to the action FIG. 10 while being durable. Preferably, action FIG. 10 is composed of a urethane or polyurethane material having a high modulus, high tensile strength and high elongation.

Alternatively, action FIG. 10 may be molded in two or more steps with the spine 46 molded from a material having a Shore hardness greater than that of the overall action FIG. 10. A combination of width and thickness of the spine 46 may be varied to achieve the desired support and flexibility for the spine 46.

Figure 2:
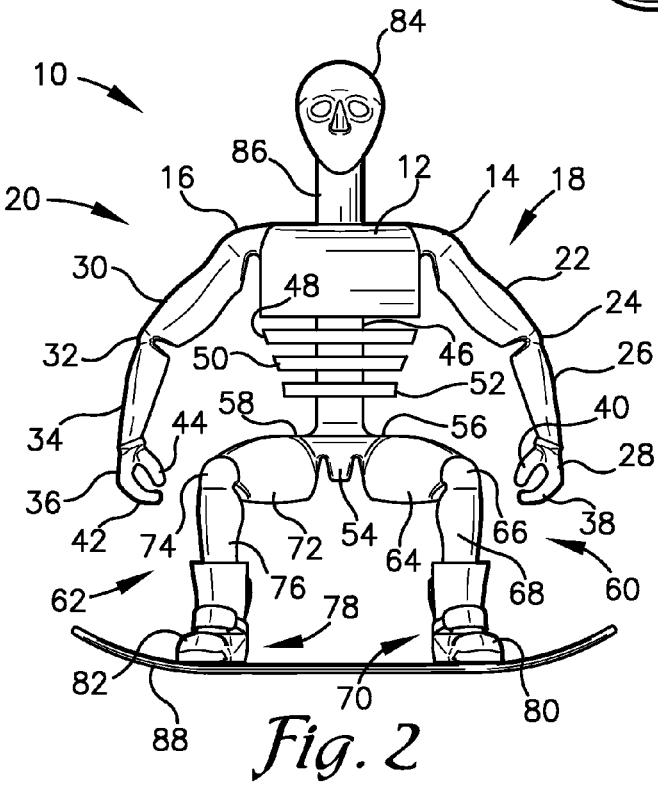
FIG. 2 is a front elevation view of the action figure shown with a snowboard.
Figure 3:
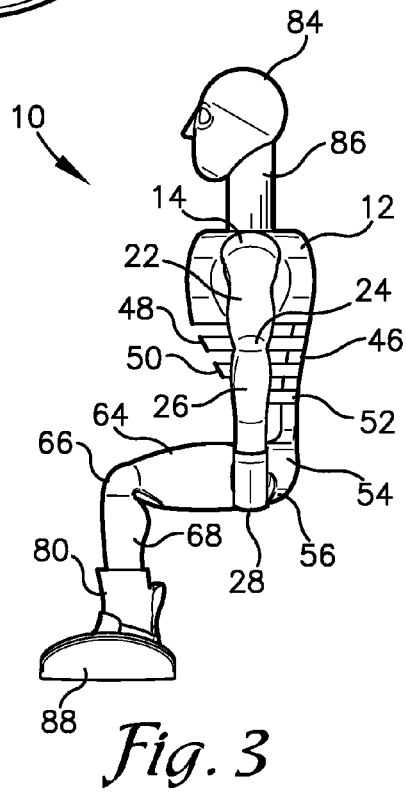
FIG. 3 is a side elevation view of the action figure of FIG. 2.
Figure 4:
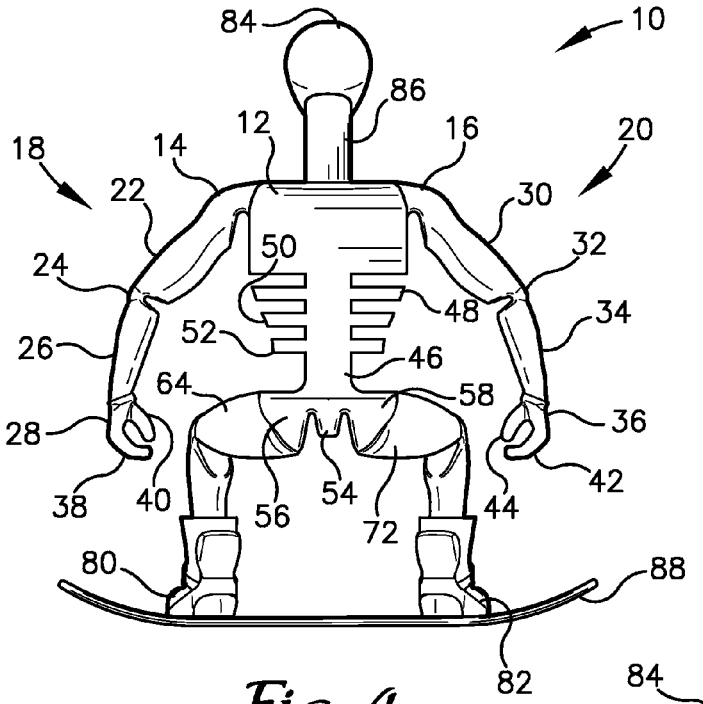
FIG. 4 is a rear elevation view of the action figure of FIG. 2.

The rib plates 48, 50 and 52 are all joined to the spine 46 and generally equidistantly spaced starting from the upper torso 12 with a larger gap between the lower rib plate 52 and the top of the pelvis 54. The rib plates 48, 50 and 52 are generally oval shaped and sized to form a taper front to back and outside to inside from the upper torso 12 to the pelvis 54. The spacing of the rib plates 48, 50 and 52 allow the action FIG. 10 to mimic the natural movement of a human body abdomen region moving side to side, forward and back, and in a forward twisting motion as shown in FIG. 1. The right knee 74 is turned slightly outward while both knees 66 and 74 are bent more than when in a static position (FIGS. 2-4). As the right hand 36 is moved forward and down to grasp the side of the snowboard 88, the upper torso 12 and spine 46 twists and bends forward. The rib plates 48, 50 and 52 rotate and compress on the right side and open up on the left side.

Figure 11:
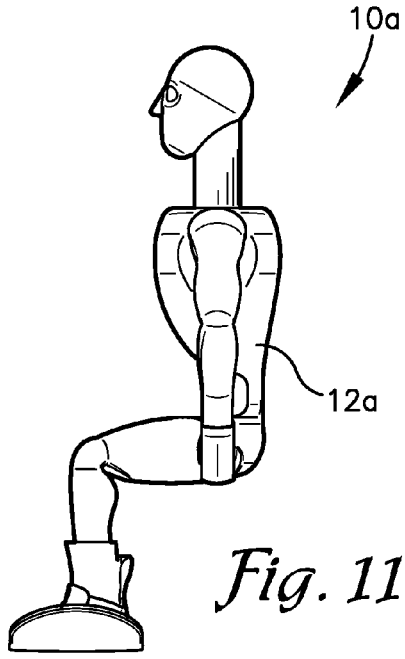
FIG. 11 is a side elevation view of the alternate embodiment of FIG. 10.

Alternatively, the upper torso 12A of action FIG. 10A may be designed with a single articulation like that of the shoulders 14 and 16, elbows 24 and 32, or knees 66 and 74, for example (see FIGS. 10 and 11). The upper torso 12A may be solid without rib plates but still allow natural twisting and movement of the upper torso 12A.

The shape of the shoulders 14 and 16, arms 18 and 20, and legs 60 and 62 are generally that of a human arm shape. Each shoulder joint 15 and 17 has an inverted U-shape to bias the respective shoulder 14 and 16 as well as the attached arm 18 and 20 slightly outwardly and downwardly along side the torso 12. The natural shape of the shoulders 14 and 16 with the additional material on the upper side of the shoulders opposite the joints 15 and 17, the arms 18 and 20 can move naturally upwardly but in a limited motion, and downwardly in a somewhat unlimited motion.

The elbows 24 and 32 each are formed by generally U-shaped or V-shaped joint 25 and 33 or groove opening on the inside of the arm 18 and 20, respectively. The elbows 24 and 32 are biased inwardly having a slight bend in the relaxed position. The shape of the elbows 24 and 32 and joints 25 and 33 allow the arms 18 and 20 to bend easily and naturally, while resisting bending backwards.

The hips 56 and 58 include hip joints 57 and 59 which are generally V-shaped. Because the hips 56 and 58 and thighs 64 and 72 are thicker than the arms 18 and 20 and shoulders 14 and 16, the hip joints 57 and 59 are generally stiffer or more rigid without as much flexibility as is natural for a hip joint.

The knees 66 and 74 each include a generally V-shaped joint 67 and 75, respectively, on the back side of the knee. The natural shape of the knees 66 and 74 with more material on the front side of the knees and the open joint 67 and 75 on the back side of the knees allows the legs 60 and 62 to bend or fold naturally at the knees 66 and 74, while restricting hyper extension of the knees 60 and 62.

In the preferred embodiment, the head 84 of the action FIG. 10 is a separate piece. The neck 86 is inserted into an aperture 87 in the upper torso 12 and can rotate within the aperture. Alternatively, the head 84 and neck 86 may be integrally formed with the torso 12 for a completely unitary construction of the action FIG. 10.

Action FIG. 10 may include sockets (not shown) in the bottom of each foot 70 and 78, which are adapted to engage or couple with other standard configuration structures or toys such as LEGOS®, for example.

It is to be understood that while certain now preferred forms of this invention have been illustrated and described, it is not limited thereto except insofar as such limitations are included in the following claims.

Having thus described the invention, what is claimed as new and desired to be secured by Letters Patent is as follows:

1. A posable figure comprising: an upper torso portion having left and right shoulders, and left and right arms extending therefrom, a pelvis having left and right hips and left and right legs extending therefrom, a flexible spine connecting said torso portion to said pelvis, said left and right arms each having an elbow, each of said elbows having a generally V-shaped opening on an inside portion of said respective left or right arms, and biased inwardly toward said upper torso portion, said left and right legs each having a knee, each of said knees having a generally V-shaped opening on a back side of said respective left or right leg, said posable figure having a unitary construction from a material having a Shore hardness of between 30A and 80D, and an elastic module of between 2 and 10 MPa; further comprising a plurality of rib plates having a generally oval-shape and joined to said spine below and spaced from said upper torso portion, wherein said upper torso position and said one or more rib plates together generally taper inwardly on each side and from front to back toward said spine.

2. The posable figure of claim 1 wherein said plurality of plates include three rib plates.

3. The posable figure of claim 1 wherein said spine is molded from a second material having a Shore hardness greater than said material.

4. The posable figure of claim 1 further comprising a neck and head attached to said neck and extending from said upper torso portion.

5. The posable figure of claim 1 wherein said left and right arms include left and right hands attached thereto respectively, each of said hands having a finger pad and a thumb.

6. The posable figure of claim 5 wherein said finger pads have separate fingers.

* * * * *